US009334682B2

(12) United States Patent
Kaplafka, Jr.

(10) Patent No.: US 9,334,682 B2
(45) Date of Patent: May 10, 2016

(54) PORTABLE ACCESS PREVENTION DEVICE

(71) Applicant: Kevin Kaplafka, Jr., Providence Forge, VA (US)

(72) Inventor: Kevin Kaplafka, Jr., Providence Forge, VA (US)

( * ) Notice: Subject to any disclaimer, the term of this patent is extended or adjusted under 35 U.S.C. 154(b) by 76 days.

(21) Appl. No.: 13/973,215

(22) Filed: Aug. 22, 2013

(65) Prior Publication Data

US 2015/0054296 A1 Feb. 26, 2015

(51) Int. Cl.

| | |
|---|---|
| ***E05C 17/44*** | (2006.01) |
| ***E05C 17/54*** | (2006.01) |
| ***E05C 19/00*** | (2006.01) |
| ***E05C 19/18*** | (2006.01) |

(52) U.S. Cl.

CPC ..... *E05C 19/004* (2013.01); *E05C 17/54* (2013.01); *E05C 19/18* (2013.01); *Y10T 292/73* (2015.04)

(58) Field of Classification Search

CPC ..... E05C 17/54; E05C 19/004; E05C 19/18
USPC ..... 292/338, 339, 342, 343, DIG. 15, 292/DIG. 60; 16/82
See application file for complete search history.

(56) References Cited

U.S. PATENT DOCUMENTS

| | | | | | |
|---|---|---|---|---|---|
| 171,807 | A | * | 1/1876 | Hoffman | 292/343 |
| 182,883 | A | * | 10/1876 | Ball | 292/339 |
| 308,823 | A | * | 12/1884 | Bitter | 292/339 |
| 349,688 | A | * | 9/1886 | Buckingham | 292/339 |
| 377,927 | A | * | 2/1888 | Campbell | 292/343 |
| 776,378 | A | * | 11/1904 | Bellamy | 292/343 |
| 804,585 | A | * | 11/1905 | Depue | 292/343 |
| 947,805 | A | * | 2/1910 | Dumont | 292/343 |
| 971,717 | A | * | 10/1910 | Bates | 292/343 |
| 1,246,707 | A | * | 11/1917 | Boynton | 292/339 |
| 1,297,189 | A | * | 3/1919 | Lawler | 292/342 |
| 1,332,473 | A | * | 3/1920 | Shirley | 292/339 |
| 1,599,595 | A | * | 9/1926 | Sponsel | 292/343 |
| 1,681,834 | A | * | 8/1928 | Arends | 254/39 |
| 2,331,150 | A | * | 10/1943 | Whiting, Jr. | 292/1 |
| 2,376,117 | A | * | 5/1945 | Bright et al. | 292/343 |
| 2,409,007 | A | * | 10/1946 | Young | 109/18 |
| 2,459,070 | A | * | 1/1949 | Gard | 292/343 |
| 2,626,826 | A | * | 1/1953 | Dritz | 292/343 |
| 2,756,527 | A | * | 7/1956 | Mease | 40/607.1 |
| 2,798,755 | A | * | 7/1957 | Zapotocny | 292/342 |
| 2,898,140 | A | * | 8/1959 | Gislason | 292/342 |
| 3,124,382 | A | * | 3/1964 | Strother | 292/343 |
| 3,328,065 | A | * | 6/1967 | Arenson | 292/343 |
| 3,642,251 | A | * | 2/1972 | Niederholtmeyer | 254/131 |
| 3,706,112 | A | * | 12/1972 | Newell | 16/82 |
| 3,731,341 | A | * | 5/1973 | Woodruff | 16/82 |
| 4,070,049 | A | | 1/1978 | Brewer | |

(Continued)

FOREIGN PATENT DOCUMENTS

| | | | |
|---|---|---|---|
| DE | 379273 | * | 8/1923 |
| DE | 390291 | * | 2/1924 |

(Continued)

*Primary Examiner* — Carlos Lugo
(74) *Attorney, Agent, or Firm* — IP Works, PLLC

(57) ABSTRACT

A portable access prevention device for use in preventing entry to rooms with inwardly swinging doors. The device leverages the force used to open a door back against the door. The stronger the force applied against the device, the greater the device increases its resistance. The device does not require complicated electronics or mechanical assemblies, nor does it need tools for installation. The device is light-weight and can be positioned in seconds.

45 Claims, 9 Drawing Sheets

(56) References Cited

U.S. PATENT DOCUMENTS

| | | | | | |
|---|---|---|---|---|---|
| 4,136,899 | A | | 1/1979 | Frasher | |
| 4,139,227 | A | * | 2/1979 | Spurr | 292/339 |
| 4,141,192 | A | | 2/1979 | Augustine | |
| 4,142,752 | A | * | 3/1979 | Chilton | 292/343 |
| 4,163,574 | A | * | 8/1979 | Chezem | 292/338 |
| 4,421,348 | A | * | 12/1983 | Kahn | 292/339 |
| 4,438,640 | A | | 3/1984 | Willis | |
| 4,478,168 | A | | 10/1984 | Wimmer | |
| 4,563,027 | A | * | 1/1986 | Chechovsky et al. | 292/339 |
| D284,738 | S | * | 7/1986 | Stone | D8/402 |
| 4,638,596 | A | * | 1/1987 | Gallardo | 49/56 |
| 4,641,869 | A | | 2/1987 | Johnson | |
| 4,666,195 | A | | 5/1987 | Thomas, III | |
| 4,805,948 | A | | 2/1989 | Renzi | |
| 4,819,296 | A | | 4/1989 | Wilkins | |
| 4,883,297 | A | | 11/1989 | Smith | |
| 4,958,869 | A | * | 9/1990 | Bisher | 292/339 |
| 5,011,200 | A | * | 4/1991 | Glancy et al. | 292/113 |
| 5,011,203 | A | * | 4/1991 | Tackett | 292/343 |
| 5,040,835 | A | | 8/1991 | Barker | |
| 5,131,701 | A | | 7/1992 | Stepniewski | |
| 5,207,464 | A | * | 5/1993 | Reeves, Jr. | 292/339 |
| 5,217,269 | A | * | 6/1993 | Wiltberger | 292/343 |
| 5,218,341 | A | | 6/1993 | Marik | |
| D339,282 | S | | 9/1993 | Malonson | |
| D344,014 | S | | 2/1994 | Marshall | |
| 5,392,026 | A | | 2/1995 | Marik | |
| D365,019 | S | | 12/1995 | Rich | |
| 5,490,304 | A | | 2/1996 | Winner, Jr. et al. | |
| 5,544,386 | A | | 8/1996 | Cobb | |
| 5,581,844 | A | | 12/1996 | Raheb et al. | |
| 5,590,928 | A | | 1/1997 | Voiculescu | |
| 5,618,072 | A | | 4/1997 | Pitchford | |
| 5,692,787 | A | | 12/1997 | Young | |
| 5,725,263 | A | | 3/1998 | Rodriguez | |
| 5,771,533 | A | | 6/1998 | Kuang-Pin | |
| 5,951,071 | A | | 9/1999 | Elliott | |
| 6,041,473 | A | * | 3/2000 | Johnson | 16/82 |
| 6,513,778 | B2 | | 2/2003 | Hefley et al. | |
| 6,557,915 | B1 | * | 5/2003 | Duff | 292/343 |
| 7,030,758 | B1 | | 4/2006 | Markegard et al. | |
| 7,195,294 | B1 | | 3/2007 | White | |
| 7,976,080 | B1 | * | 7/2011 | Duff | 292/343 |
| 2008/0309100 | A1 | * | 12/2008 | Ollinger | 292/339 |
| 2013/0318882 | A1 | * | 12/2013 | Booker et al. | 49/506 |

FOREIGN PATENT DOCUMENTS

| | | | | | |
|---|---|---|---|---|---|
| DE | 29913711 | U1 | * | 12/1999 | |
| FR | 736252 | | * | 11/1932 | |
| GB | 309682 | | * | 4/1929 | |
| GB | 581634 | | * | 10/1946 | |
| GB | 2478366 | B | * | 8/2014 | |
| WO | WO 8902509 | A1 | * | 3/1989 | E05F 5/00 |
| WO | WO 0136769 | A1 | * | 5/2001 | |

* cited by examiner

FIG. 8
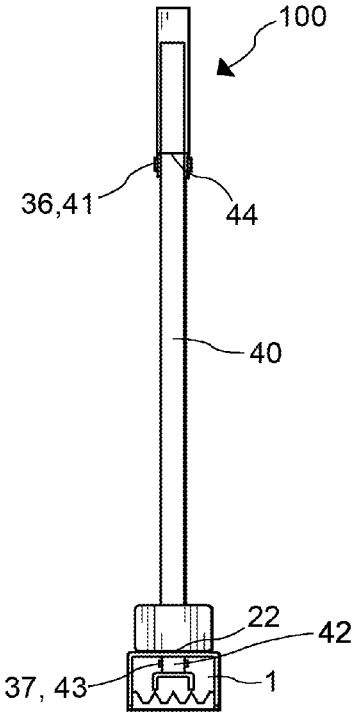
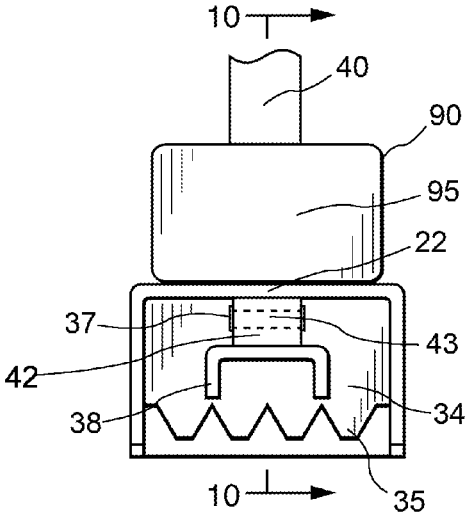
FIG. 9
FIG. 10
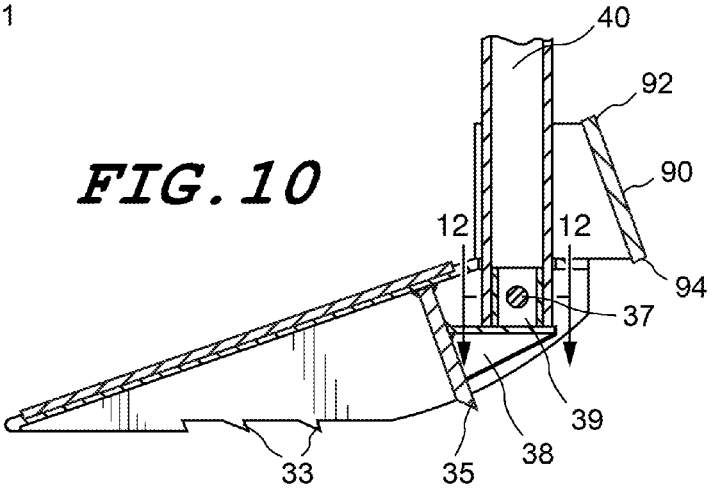

FIG. 21
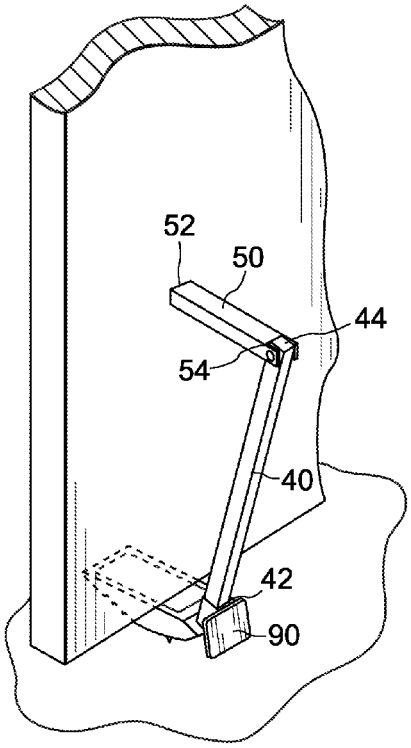
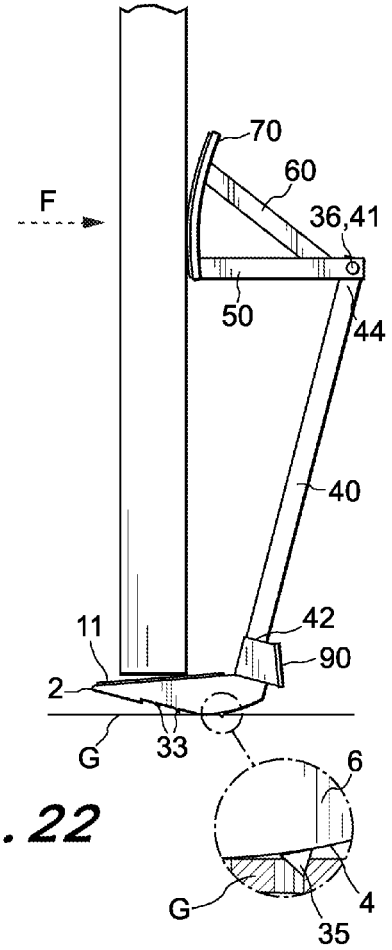
FIG. 22

PORTABLE ACCESS PREVENTION DEVICE

FIELD OF INVENTION

The present invention relates to a device that prevents the opening of inwardly swinging doors so that intruders cannot access a room. More specifically, the invention relates to a portable device which has the capability of leveraging the forces applied against it to increase its resistance and prevent a breach.

BACKGROUND OF THE INVENTION

In an emergency, there is little time, if any, to ascertain the nature of a threat. For example, when hostile parties forcefully attempt to gain entry to a room, protecting those at risk becomes a top priority. As a security measure, those at risk should shut doors to prevent potential threats from entry. However, due to ensuing panic, unfamiliarity of surroundings, or because those stranded in rooms seek cover, the opportunity to properly seal an entrance may not exist. Even correctly shut doors may not have locking mechanisms to remain closed. Further, intruders can access a locked door with keys or by forced entry. Violent open-and-close movements, repeated ramming forces, and swift, powerful strikes are all ways threatening parties can gain access to a room with an inwardly swinging door regardless of its locking mechanisms.

The stronger the force used to breach a room, the likelier a typical anti-breach tool will fail. Most tools known in the art become less effective as the force applied against them increases. Conventional ways of preventing a door from inwardly opening involve cumbersome tools and devices that often snap, break, slip, and/or slide when a sufficient force is applied against them. Usually anchored underneath a doorknob, these tools extend to the ground at some point in front of the door. Constant back-and-forth jerking motions can easily jostle them loose. Without proper anchoring into the door the tool has a greater chance to freely slide away and fall off the door.

Fixing the tool to the door by welding or with hardware may circumvent these problems. However, these tools are impractical for a number of reasons, as they: are not transportable; are not cost effective; permanently leave holes and other structural flaws in doors; and if they have not yet been installed at the time of an emergency, they cannot be easily or quickly attached.

Other anti-breach devices known in the art contain complex mechanical assemblies involving gears and/or chains. If one part in the assembly fails then the entire device becomes useless. A threatening party who violently and repeatedly pushes against a door can easily loosen a chain or dislodge a gear. Additional devices in the art utilize sophisticated electronic components. Unfortunately, there is no guarantee that electronic anti-breach devices will have the necessary electricity to operate in an emergency. Threatening parties can easily cut power sources to rooms, and, for various reasons, emergency responders may need to cut power, thus inadvertently enabling breach conditions.

If those at risk need to evacuate, permanently fixed tools must stay behind, leaving subsequently encountered doors unprotected. Effective anti-breach tools must travel with those at risk to guard against the possibility of unlocked doors. Prohibitively heavy or cumbersome tools cannot travel with those at risk even if they do not require permanent anchoring. Many of the known tools in the art having numerous parts may weigh too much to easily be carried from room to room in an emergency.

Therefore, there is a need in the art for a portable access prevention device that does not snap, break, slip, and/or slide when a force is applied against it, becomes more resistant to an opposing force as that opposing force increases, is easily transportable, is cost effective, and does not require electricity or intricate mechanical assemblies.

SUMMARY OF THE INVENTION

In order to solve the need in the art for a portable access prevention device that does not snap, break, slip, and/or slide when a force is applied against it, becomes more resistant to an opposing force as that opposing force increases, is easily transportable, is cost effective, and does not require electricity or intricate mechanical assemblies, the present invention has been devised.

The present invention is a portable access prevention device for use in preventing the opening of inwardly swinging doors. The present device functions by leveraging the force used to open a door back against the door. The device does not require electronics or complicated mechanical assemblies to operate. Whereas many devices known in the art fail when faced with a powerful enough force, the present device's effectiveness (i.e. resistance) increases as the force against the door becomes stronger. This serves as an object of the invention: the present invention leverages the force used to open the door as the means of preventing entry. Since the device leverages opening force, the greater the force applied against the door to open the door, the more resistant the device becomes.

The device includes a series of interrelated structural elements, all composed of durable materials adapted to resist strong mechanical stresses, strains, and forces. These elements are substantially hollow to reduce the overall weight of the device without compromising strength. The base of the device is a wedge element having a tapered toe at its front and a heel at its back. A sloped top starts at the top of the wedge and terminates at the toe. This shape helps drive the wedge element under the door when the device is in use. Each time an intruder attempts to force the door open the device leverages that force to drive the wedge further under the door. Therefore, the wedge provides resistance by jamming the bottom of the door into the sloped surface more and more as the intruder's force increases. If the wedge can travel no further under the door, the device rocks backwardly with the motion of the force, and anchoring elements located under the wedge dig into the ground.

Another object of the invention is to provide fast and easy installation. When users involved in an emergency need to quickly seal entrances, the present invention simply needs to be placed against the door, have the toe of the base wedge element inserted under the door, and have its contact means rotated into place against the door. In some embodiments, users can kick the kickplate located on top of the wedge to facilitate installation. The device requires no hardware or tools for installation. The user need not worry about charging batteries or finding a power source to engage the device. The contact means may include the faceplate and support brace configuration shown in FIG. 20, or the elementary leverage arm configuration shown in FIG. 21.

Yet another object of the invention is its capability for easy transport and storage. The device takes up little space, especially when not in use, as the contact means folds when disengaged from the door. The device fits in small crawl spaces, underneath furniture, and in closets. Users can pick up the device whenever they need it and easily transport it from storage to the door. If users exit a room and need to take the device with them, they simply disengage the contact means, pull the toe out from under the door, and carry it with them. Since the device does not require permanent anchoring, and the generally hollow structural components are not prohibitively heavy, the present invention is easily portable. Further, when facing a crisis, users can easily grasp the device, place it in front of the door, and engage it without having to drag an unwieldy tool across the room.

The following description best describes the present invention's functionality: a user inside a room places the device on the ground and facing an inwardly swinging door. In this context, "facing" the door means having the tapered toe of the wedge element pointed toward the door. Also, in this context and throughout all embodiments of the invention, "ground" refers to exterior and interior surfaces, including floors, as well as any surface below the path of an inwardly swinging door. Preferably, the user inserts the wedge element toe first into the gap between the underside of the door and ground as far as possible. However, the device may still function if the toe is substantially close to the bottom of the door and not yet underneath it, provided the base of the door catches the sloped surface of the wedge element.

The user then swings the contact means about its pivotal attachment with the leverage shaft such that the contact means abuts the door. Once the contact means abuts the door, the device is engaged and ready to prohibit entry. The contact means may either be the free end of the leverage arm or a faceplate permanently fixed to the leverage arm. The faceplate has a surface area of greater dimension than the cross-sectional shape of the free end of the leverage arm. In the preferred embodiment, the faceplate is convex and covered in rubber treads to increase frictional contact. A similar material that increases friction covers the sloped top surface of the wedge element.

When an intruder attempts to open the door to gain entry, the applied force used to open the door exerts against the device. The force transfers to the contact means and leverage arm, thus pushing them in the direction of the force. The top end of the leverage shaft, coupled to the contact means by pivotal attachment, also travels in the direction of the force. The bottom end of the leverage shaft, in rigid connection with the wedge element, thrusts forwardly towards the door and downwardly into the ground.

As the leverage shaft moves forwardly, it drives the wedge element further under the door. As the force applied against the door increases, the base of the door advances further up the sloped top surface of the wedge element. When the door can travel no further up the wedge element, applied forces may urge the device to rock backwardly. The rounded, angled, or curved heel of the wedge element is adapted to rock backwardly forcing the sloped surface near the toe end up against the door, thus preventing the device from slipping or sliding out from the door.

Anchoring cleats on the underside of the heel of the wedge element provide added stability by digging in to the ground. Some embodiments include grasping teeth longitudinally disposed along the bottom and protruding from the bottom right and left edges of the of the wedge element to further increase the resistance. As the force against the door increases, so does the resistance offered by the device. Furthermore, since the leverage shaft thrusts the wedge element downwardly, the resistance provided by the anchoring cleats, grasping teeth, and other protrusions extending from the bottom and heel of the wedge element increases with stronger force applied against the device from a would-be intruder.

As such, those skilled in the art will appreciate that the conception, upon which this disclosure is based, may readily be utilized as a basis for the designing of other structures, methods, and systems for carrying out the several purposes of the present invention. It is important, therefore, that the claims be regarded as including such equivalent constructions insofar as they do not depart from the spirit and scope of the present invention. These and other constructions will become obvious to those skilled in the art from the following drawings and detailed description of the preferred embodiment.

BRIEF DESCRIPTION OF THE DRAWINGS

FIG. 8 is a rear side elevation drawing of an alternate embodiment of the present invention.

FIG. 9 is a rear side elevation drawing of a wedge element and kick plate of the present invention.

FIG. 10 is a cross-sectional view of a wedge element and kick plate of the present invention taken along line 10-10 as shown in FIG. 9.

FIG. 21 is a rear left isometric drawing of an alternate embodiment of the present invention engaging a door.

FIG. 22 is a left elevation drawing of a preferred embodiment of the present invention while in use.

DETAILED DESCRIPTION OF THE PREFERRED EMBODIMENTS

The following detailed description and corresponding drawings are of the best currently contemplated modes of carrying out exemplary embodiments of the invention. The description is not to be taken in a limiting sense, but is made for the purpose of illustrating the general principles of the invention.

Figure 1:
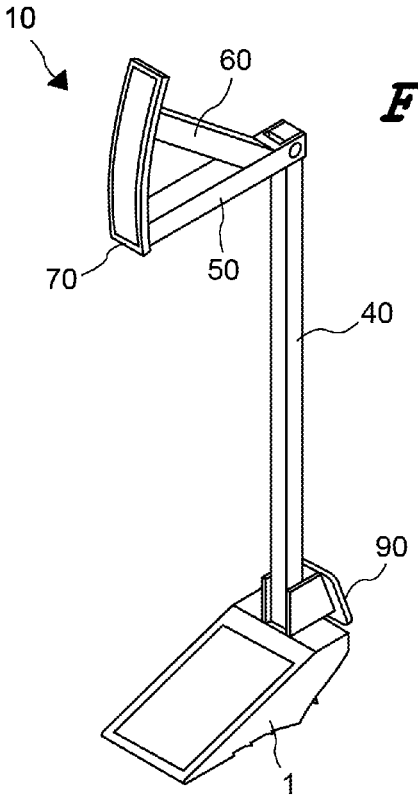
FIG. 1 is a front left isometric drawing of a preferred embodiment of the present invention.

FIG. 1 shows an exemplary embodiment of the present invention, a portable access prevention device 10. The device 10 includes a plurality of durable structural components, including the leverage shaft 40, leverage arm 50 and support brace 60. Preferably, these components are made of 0.75 inch square steel tubing. FIG. 1 also shows wedge element 1, the base of device 10, kick plate 90, and faceplate 70. Preferably, wedge element 1, kick plate 90 and faceplate 70 are made of 0.25 inch steel plating. Conceivably, the structural components of the device 10, including the wedge element 1, leverage shaft 40, leverage arm 50, support brace 60, and faceplate 70 may be made of any material that can withstand mechanical stresses, strains, and strong forces, including, but not limited to: polymer, polypropylene fiber mix, fiberglass, carbon fiber, aluminum, wood, or combinations thereof.

Figure 2:
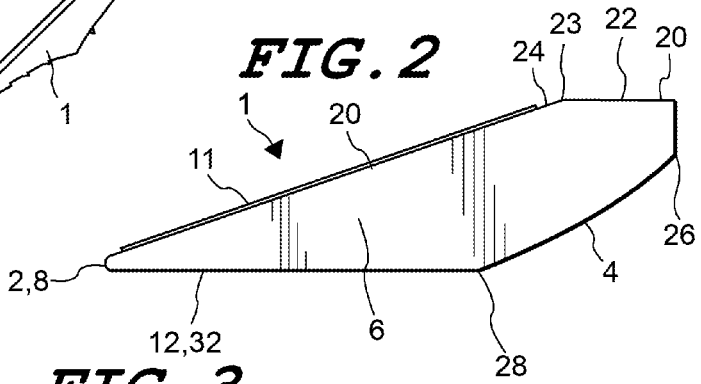
FIG. 2 is a left side elevation drawing of a wedge element of the present invention.
Figure 3:
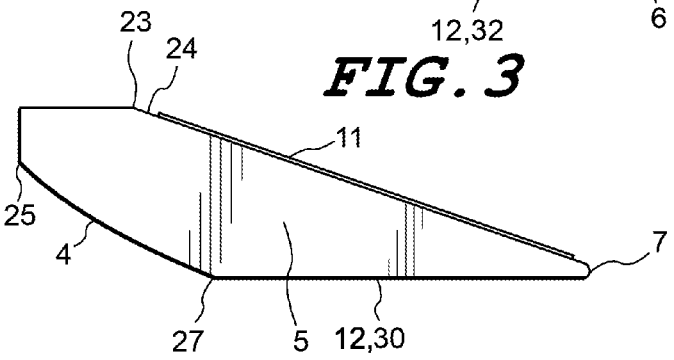
FIG. 3 is a right side elevation drawing of a wedge element of the present invention.
Figure 11:
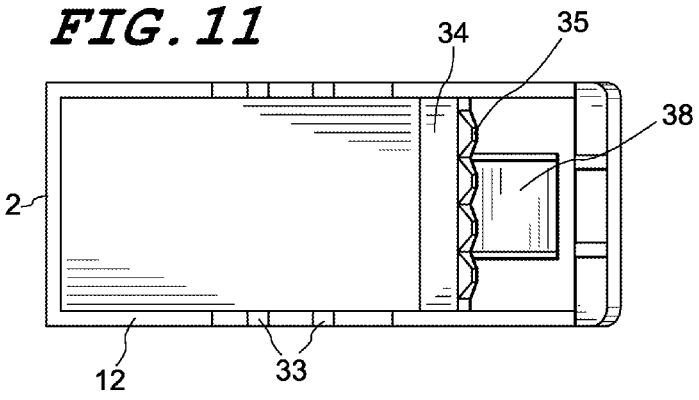
FIG. 11 is a bottom plan drawing of a wedge element of the present invention.

FIG. 2 illustrates a left elevation view of wedge element 1 in detail. Wedge element 1 has a toe 2, heel 4, right side 5 (as shown in FIG. 3), a left side 6, a bottom 12 and a top 20. Top 20 has two surfaces; a horizontal surface 22 and a sloped surface 24. Bottom 12, the surface that abuts the ground, is substantially flat, although some embodiments employ anchoring means protruding from bottom 12 as shown in FIG. 11. Horizontal surface 22 is substantially parallel bottom 12, whereas sloped surface 24 slopes downwardly, ultimately terminating at bottom 12 to form toe 2. Toe 2 is bounded on either side by right toe point 7 (as shown in FIG. 3) and left toe point 8. Heel 4 is preferably rounded, but may also be angled, arcuate, curved, or shaped such that it rocks backwardly when a force exerts against the device 10. On the left side 6, heel 4 meets at bottom 12 at left bottom point 28. The segment extending between left toe point 8 and left bottom point 28, i.e. the segment formed where bottom 12 meets left side 6, is left edge 32.

FIG. 3 illustrates the right elevation view of wedge element 1 in detail. Substantially planar surfaces bound wedge element 1 at its right and left sides. Neither right side 5 nor left side 6 extends past the other surfaces of the wedge element. Therefore, wedge element 1 has well-defined edges at horizontal surface 22, a sloped surface 24 and bottom 12.

Right side 5, complete with right toe point 7 and right bottom point 27, are shown. The segment extending between right toe point 7 and right bottom point 27, i.e. the segment formed where bottom 12 meets right side 5, is right edge 30.

Figure 4:
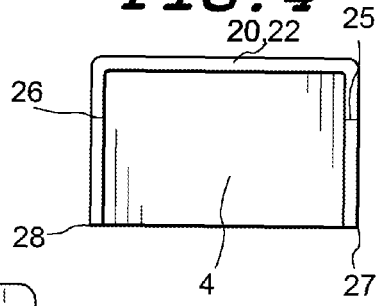
FIG. 4 is a rear side elevation drawing of a wedge element of the present invention.

FIG. 4 depicts heel 4 as it extends to the horizontal surface 22 of top 20 to form right back point 25 and left back point 26. The heel 4 meets at bottom 12 on the right side 5 at right bottom point 27 and at the left side 6 at left bottom point 28.

Figure 5:
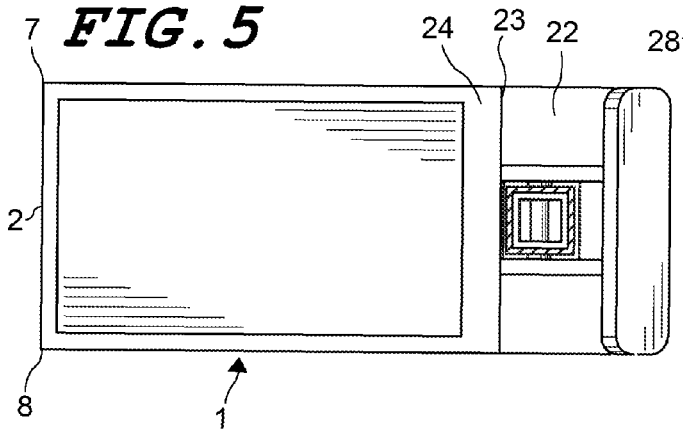
FIG. 5 is a top plan drawing of a wedge element of the present invention.

FIG. 5 depicts a top view of wedge element 1. The sloped surface 24 is substantially planar and bounded at its bottom edge by toe 2 and at its top by front edge 23. Right toe point and left toe point 8 bound either side of toe 2. Sloped surface 24 meets horizontal surface 22 to form front edge 23 which is also shown in FIGS. 2 and 3. In exemplary embodiments, sloped surface 24 includes a panel of frictional material 11 that increases the coefficient of friction between it and other surfaces, such as rubber or silicone treads, or even sandpaper. Typically made of 0.25 inch steel plating, wedge element 1 can also be the same material as the other structural elements. Further, the entire wedge element 1 can be made of rubber, silicone, or similar material that increases friction between it and the base of the door. And, although a panel of frictional material 11 covers sloped surface 24, having a rubber or silicone wedge element 1 will increase friction between it and the door.

Figure 6:
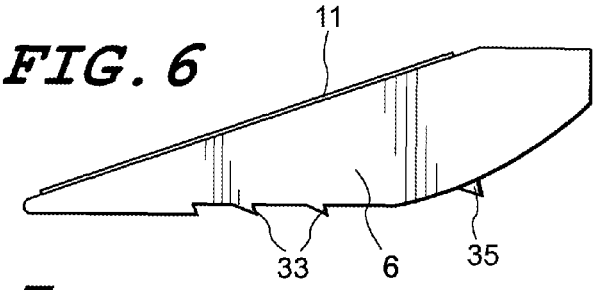
FIG. 6 is a left side elevation drawing of a wedge element of the present invention.
Figure 7:
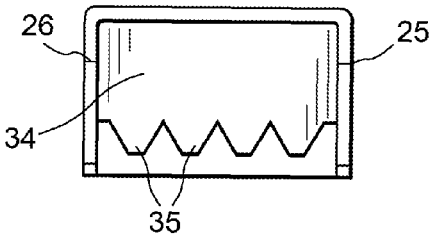
FIG. 7 is a rear side elevation drawing of a wedge element of the present invention.

FIGS. 6 and 7 illustrate embodiments of wedge element 1 that include various anchoring elements used to enhance the device 10's overall resistance. When the device 10 is in use, these anchoring elements dig in to the ground or respective surface, thus increasing resistance and stability. As the force against the device 10 increases, so do the anchoring elements' ability to dig deeper into the ground. These anchoring elements include cleat or teeth-like protrusions which extend from the bottom 12. The heel 4 may also have cleat or teeth-like protrusions that engage the ground when the device 10 rocks backwardly.

FIG. 6 depicts a plurality of grasping teeth 33 protruding from the bottom 12. Exemplary embodiments have at least one protrusion extending from the bottom right and left edges 5 and 6. In many embodiments, the protrusions are longitudinally disposed along the bottom 12. The sawtooth-shaped construction of the grasping teeth 33 is ideal for digging into the ground. Grasping teeth 33 may have other shapes adapted to better dig into the ground. In some embodiments, grasping teeth 33 are flush with right side 5 and left side 6. FIG. 6 further depicts the end of an anchoring cleat 35 protruding past the heel 4. Anchoring cleats 35 are additional protrusions that extend from the back of heel 4.

FIG. 7 depicts a plurality of anchoring cleats 35 extending from anchoring plate 34. Permanently bonded to heel 4 for increased stability, anchoring plate 34 is preferably made of 0.25 inch steel plating but may be made of other materials able to withstand mechanical stresses, strains, and forces, including, but not limited to: polymer, polypropylene fiber mix, fiberglass, carbon fiber, aluminum, wood, or a combination thereof. As shown in FIG. 7, anchoring cleats 35 typically have a wedge shape to better dig into the ground.

FIG. 8 illustrates leverage shaft 40 extending through the horizontal surface 22 of wedge element 1. A structural element having a slender, elongate body, preferably made of square 0.75 inch steel tubing, leverage shaft 40 has a bottom end 42 and a top end 44. Both ends 42 and 44 couple to other components of device 10. FIG. 1 shows leverage shaft 40 having a substantially pillar-like shaft with a substantially square cross-sectional shape, but the invention can function with various other shapes, such as a substantially cylindrical shaft or a substantially triangular shaft. The longer the leverage shaft 40, the greater the amount of leverage force it can apply to the other structural components of device 10. Further, leverage shaft 40, like the other structural elements of the device 10, may be made of other materials able to withstand mechanical stresses, strains, and forces, including, but not limited to: polymer, polypropylene fiber mix, fiberglass, carbon fiber, aluminum, wood, or a combination thereof.

Top attachment means 41 pivotally couples top end 44 to contact means 100, and bottom attachment means 43 rigidly connects bottom end 42 to wedge element 1. In the preferred embodiments, attachment means 41 utilizes a bolt 36 or other hardware capable of providing pivotal movement. In alternate embodiments, the attachment means 41 provides hinged attachment between top end 44 and the contact means 100.

Top attachment means 41 utilizes holes drilled through the top end 44 and adapted to accept a bolt 36 or other hardware capable of providing pivotal movement. Similarly, bottom attachment means 43 utilizes holes drilled through the bottom end 42 and adapted to accept a pin 37, or other hardware capable of providing rigid connection, such as a friction pin or cotter pin. The invention does not require that both attachment means 41 and 43 utilize the same size and dimension of hardware and holes.

FIG. 9 highlights the components used in the rigid connection of bottom attachment means 43. Leverage shaft 40 extends through horizontal surface 22 and rests on shelf 38. Shelf 38, extending from and welded to anchoring plate 34, further includes pillar 39 (as best seen in FIG. 10). Pillar 39 also includes holes adapted to accept pin 37. Pin 37 inserts through the holes drilled into the bottom end 42 of leverage shaft 40 and pillar 39 so that leverage shaft 40 remains stationary when the device 10 is in use. By resting on shelf 38, covering pillar 39, and secured by pin 37, leverage shaft 40 can downwardly and forwardly drive wedge element 1 further under the door and into the ground when a force applies against the device 10 without unwanted movement.

FIG. 9 also provides a close-up view of kick plate 90. Kick plate 90 extends from the leverage shaft 40 and is adapted to receive swift, powerful strikes, like a kick or punch, from the user. Kick plate 90 facilitates the positioning of the wedge element 1, as a swift kick will drive toe 2 further underneath the door. Device 10 still functions in embodiments that do not include kick plate 90, but its presence is preferred. Kick plate 90 includes a substantially planar element extending from the surface of the leverage shaft 40 facing opposite the door. Kick plate has a front surface 95 which faces the user. The kick plate 90 will best drive the toe 2 under the door when positioned as far down the leverage shaft 40 as possible.

The kick plate 90 still performs its function when in communication with the heel 4. For instance, alternate embodiments for the kick plate 90 to extend from shelf 38 or near the edge of bottom leverage shaft end 42.

Figure 12:
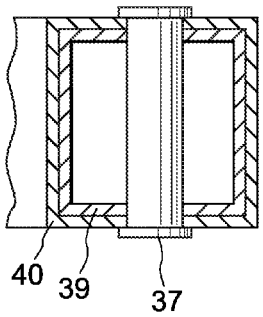
FIG. 12 is a cross-sectional view of a leverage shaft taken along line 12-12 as shown in FIG. 10.

FIGS. 10 and 11 provide views of the wedge element 1 and its connection to leverage shaft 40. These views also show shelf 38 extending from anchoring plate 34. Anchoring plate 34 extends from a point 31 underneath the wedge element 1 at a surface opposite the sloped surface 24. Anchoring plate 34 has cleats 35 protrude past the outermost edge of heel 4. As best seen in FIGS. 10 and 12, the outer cross-sectional dimensions of pillar 39 are substantially the same as the inner cross-sectional dimensions of leverage shaft 40. When pillar 39 accepts leverage shaft 40, its outer dimensions directly abut the inner surface of leverage shaft 40. This configuration allows for greater stability and easier alignment of the holes that accept pin 37. Further, FIG. 10 depicts kick plate 90 having its top edge 92 closer to the leverage shaft 40 than its bottom edge 94. This angled configuration facilitates contact by a user's foot or fist when striking kick plate 90.

FIG. 12 best illustrates how pillar 39 accepts leverage shaft 40. As shown, the outer cross-sectional dimension of pillar 39 is substantially the same as the inner cross-sectional dimension of leverage shaft 40. With no gaps between pillar 39 and leverage shaft 40, the device 10 will not, rock, twist, vibrate, or create other unwanted movements when the device 10 is in use. Further, this direct abutment provides greater overall structural strength.

Figure 13:
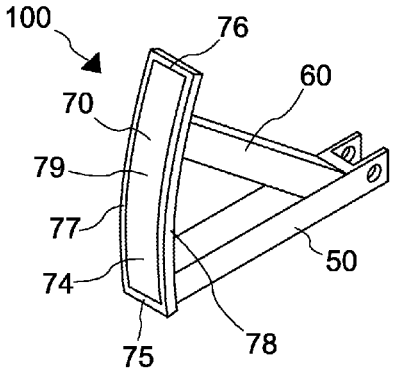
FIG. 13 is a front left isometric drawing of a contact means of the present invention.
Figure 14:
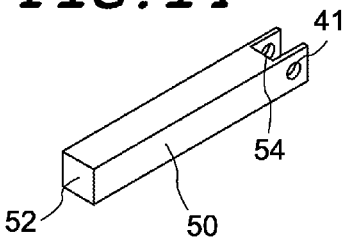
FIG. 14 is a front left isometric drawing of an alternate embodiment of the contact means, showing the leverage arm only, of the present invention.

FIG. 13 provides a view of contact means 100, the element that abuts the door when the device 10 is engaged. Contact means 100 has various forms, and may be just the leverage arm 50 as shown in FIG. 14, or the more complicated embodiment including support brace 60 and faceplate 70 seen here. In some embodiments, to ensure engagement with the door, the user can equip contact means 100 with a retractable spring means. Although this spring may restrict the overall movement of the contact means, particularly in a circular motion away from the door, it snaps the leverage arm 50 in place with the door for improved engagement.

Figure 15:
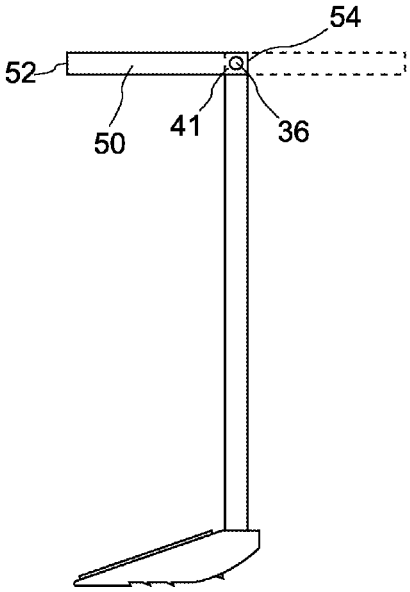
FIG. 15 is a left elevation drawing of an alternate embodiment of the contact means, showing the leverage arm only, of the present invention.

FIGS. 14 and 15 depict leverage arm 50 having first end 52 and second end 54, wherein the second end 54 pivotally engages top end 44 of leverage shaft 40 at top attachment means 41. Holes drilled through the leverage arm second end 54 and top end 44 of leverage shaft 40 are aligned and adapted to accept a bolt 36 or similar hardware capable of providing pivotal attachment. When contact means 100 uses a configuration of only the leverage arm 50, first end 52 abuts the door. FIG. 15 depicts second end 54 as a pair of flanges extending past the elongate body of leverage arm 50. Top end 44 of leverage shaft 44 inserts into these flanges and accepts the bolt 36 to form top attachment means 41. When not in use, the leverage arm 50 may swing freely in both directions about the pivot.

Like other structural components of the device 10, leverage arm 50 is preferably made of 0.75 inch steel tubing, but may be made of other materials able to withstand mechanical stresses, strains, and forces, including, but not limited to: polymer, polypropylene fiber mix, fiberglass, carbon fiber, aluminum, wood, or a combination thereof. Further, in the preferred embodiment, leverage arm 50 has a substantially rectangular shape, but alternate embodiments utilize the various shapes, including a substantially cylindrical beam, a substantially square beam, or substantially triangular beam. Usually, the leverage arm 50 has a slender, elongate body, similar to the leverage shaft 40, albeit not as long. The leverage arm 50 typically has a cross-sectional area of generally small dimensions relative to the size of the door. As the cross-sectional area of the first end 52 increases, so does the overall stability, resistance, and effectiveness of the device 10, as greater area is capable of distributing a stronger force.

When the device 10 is in use, first end 52 abuts the door. In this position, the device is said to "engage" the door. To engage the door, a user swings the leverage arm 50 about the pivotal attachment means 41 until first end 52 abuts the door (as shown in FIG. 21). In this configuration, the inwardly swinging door remains in place by the engaged leverage arm when an intruder attempts entry. Flipping the leverage arm 50 in the opposite direction effectively disengages the device 10.

Figure 16:
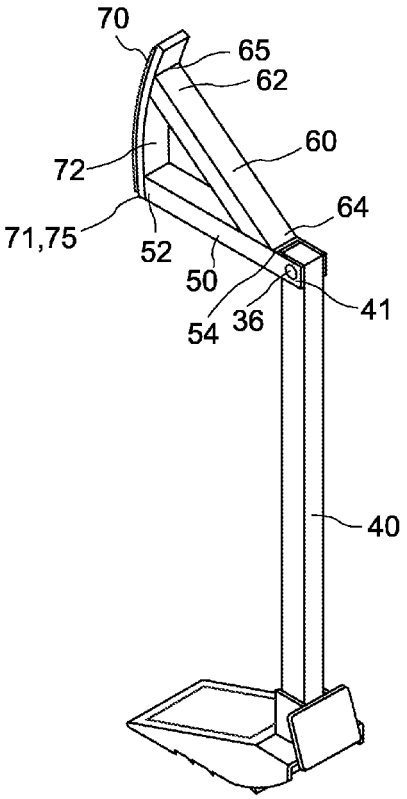
FIG. 16 is a rear left isometric drawing of a preferred embodiment of the present invention.

Referring now to FIG. 16, first end 52 of leverage arm 50 fastens to the back surface 72 of faceplate 70, usually by strong bonds such as welding or hardware. This connection is typically made at a lower connection point 71 located substantially near the bottom edge 75 of back surface 72. Faceplate 70 also has a front surface 74 that abuts the door when the device is in use. Faceplate 70 is preferably made of 0.25 steel plating but may be made of the other materials able to withstand mechanical stresses, strains, and forces, including, but not limited to: polymer, polypropylene fiber mix, fiberglass, carbon fiber, aluminum, wood, or a combination thereof.

Referring again to FIG. 13, the preferred embodiment of a convex faceplate 70 is shown, although some embodiments employ a substantially planar faceplate. This convex shape facilitates the backward movement of the device 10 force is applied against it. The convex shape ensures that a section of surface area on faceplate front surface 74 will always contact the door when the device 10 is engaged. In FIG. 13, the faceplate 70 has substantially the same lateral dimension as the cross-sectional shape of leverage arm 50. However, faceplate 70 has a greater longitudinal dimension than that of the leverage arm to create a greater cross-sectional area. Faceplate 70 has substantially straight top and bottom edges 76 and 75, respectively, connected by convex right and left edges 77 and 78, respectively. The convex front faceplate surface 74 may be covered with a material 79 that increases the friction between the front faceplate surface 74 and door, such as rubber or silicone treads, and even sandpaper.

Figure 17:
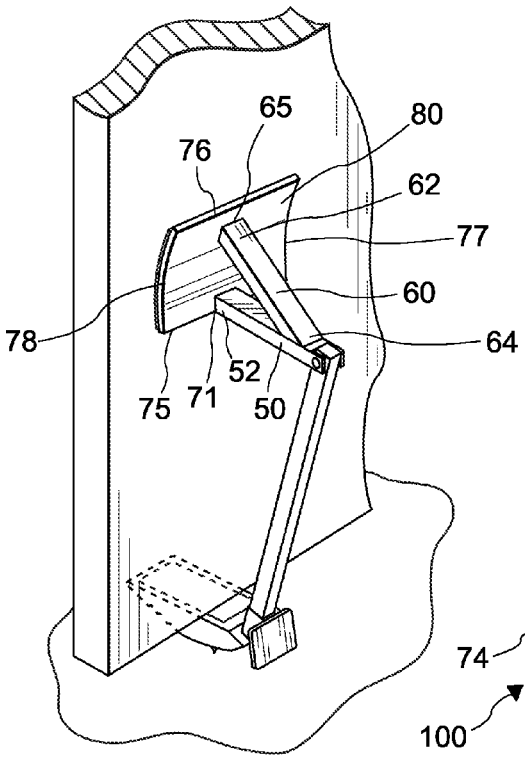
FIG. 17 is a rear left isometric drawing of an alternate embodiment of the contact means of the present invention engaging a door.

FIG. 17 depicts an alternate embodiment of a faceplate 80 having a substantially greater longitudinal and lateral dimensions compared to that of leverage arm 50. This embodiment enhances the chance for contact between the door and faceplate 80 as the faceplate 80's surface area has increased.

As seen in FIGS. 13 and 16, support brace 60 provides added structural stability and support for faceplates 70 and 80 (as shown in FIG. 17). Support brace 60, like the other structural elements of device 10, is preferably made of 0.75 inch steel tubing, but may be made of the other materials able to withstand mechanical stresses, strains, and forces, including, but not limited to: polymer, polypropylene fiber mix, fiberglass, carbon fiber, aluminum, wood, or a combination thereof. Further, the drawings depict the support brace 60 as a substantially elongate rectangular beam but alternate embodiments utilize the various shapes including, but not limited to, a substantially cylindrical beam, a substantially square beam, or a substantially triangular beam.

Support brace 60 has a first end 62 and a second end 64. First support brace end 62 is fixed to back surface 72 in a similar fashion to the permanent bonding of first leverage arm end 52 to back faceplate surface 72. However, first support brace end 62 meets back faceplate surface 72 at upper connection point 65 located at a higher longitudinal point than where the first leverage arm end 52 connects to back faceplate surface 72 at lower connection point 71. Similarly, second support beam end 64 is permanently bonded to leverage arm 50.

Figure 18:
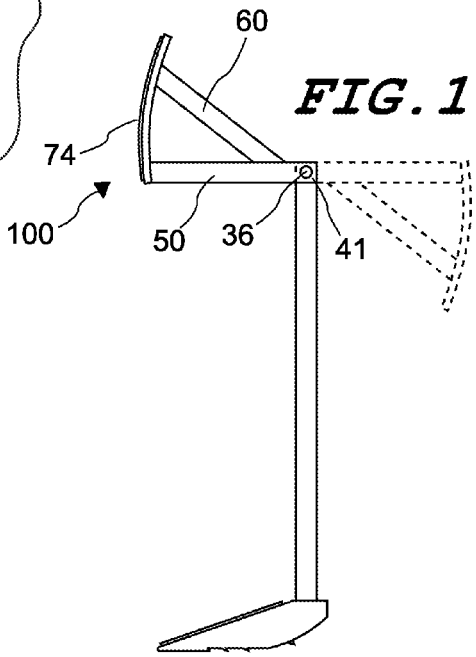
FIG. 18 is a left elevation drawing of a preferred embodiment of the present invention demonstrating the positions of the contact means.

With both support brace ends 62 and 64 permanently fixed to back faceplate surface 72 and leverage arm 50, respectively, support brace 60 acts as a handle for the device. As shown in FIG. 18, the user flips the contact means 100 in place by rotating the leverage arm 50 about its pivotal attachment means 41 simply by handling the support brace 60. The user can transport the device 10 by picking it up from the support brace 60. The phantom lines depict a disengaged contact means 100, i.e. the position of the contact means before it flips into place. Further, due to the permanent bonds, users can transport the device 10 by picking it up from support brace 60.

Figure 19:
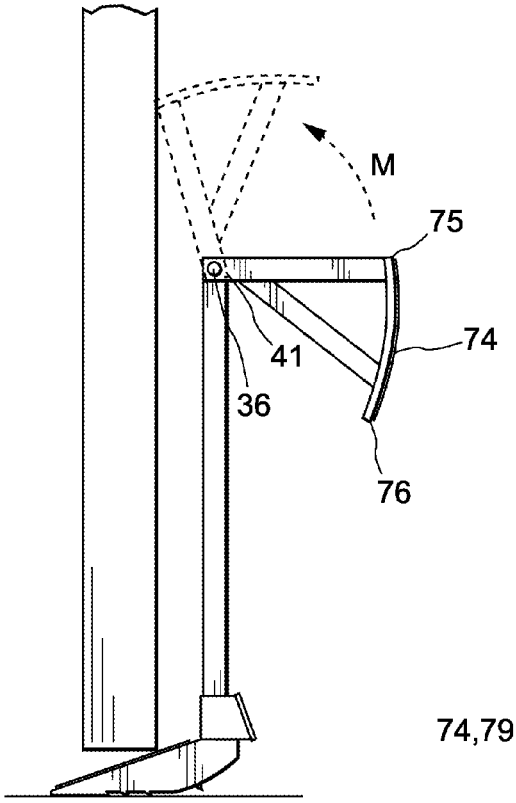
FIG. 19 is a left elevation drawing of a preferred embodiment of the present invention positioned too close to a door and demonstrating the positions of the contact means.

FIG. 19 depicts the device 10 just prior to engaging the door. Device 10 faces the door with toe 2 inserted in the gap between the door and ground. Ideally, the user will place the device as close to the door as possible. The contact means 100 moves about the pivot created by top attachment means 41 in the direction illustrated by the curved arrow M. Movement ceases when the front faceplate surface 74 abuts the door.

Figure 20:
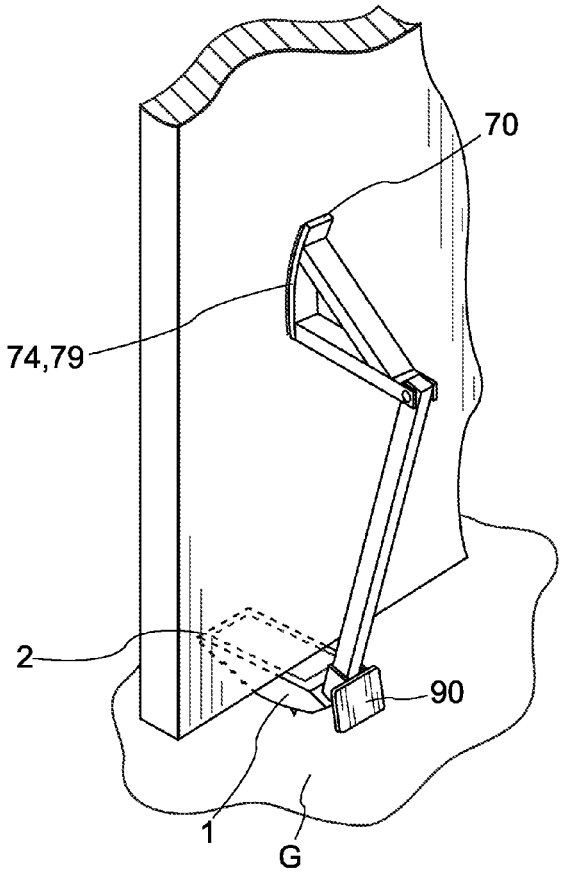
FIG. 20 is a rear left isometric drawing of a preferred embodiment of the present invention engaging a door.

FIG. 20 depicts an isometric view of device 10 after contact means 100 engages the door. The contact means 100 includes faceplate 70, with front faceplate 74 (or, depending on the embodiment, frictional material 79) abutting the door. Wedge element 1 is placed on the ground G with toe 2 underneath the door as indicated by the phantom lines. The bottom of the door surface abuts sloped surface 24 of wedge element 1. To better drive wedge element 1 under the door, the user may strike kick plate 90.

Similarly, FIG. 21 also provides an isometric view of device 10 after contact means 100 engages the door. However, FIG. 20 depicts the simpler contact means 100 having only the leverage arm 50. First end 52 of leverage arm 50 does provide resistance against the door when forces are applied, but preferable embodiments of contact means 100 include the faceplates 70 and 80 having greater cross-sectional surface areas as shown in FIGS. 16 and 17, respectively.

FIG. 22 illustrates the device in use. An intruder applies a force against the door to attempt entry as indicated by arrow F. Contact means 100, shown in an engaged position as faceplate 70 abuts the door, moves incrementally in the same direction as arrow F. Top end 44 of leverage shaft 40, pivotally coupled to contact means 100 by top attachment means 41, also travels in the direction of force F. Bottom end 42 of leverage shaft 40, in rigid connection with the wedge element 1 at bottom attachment means 43 (not shown here, see FIG. 9), thrusts forwardly and downwardly, thus driving wedge element 1 further under the door and anchoring elements deeper into the ground G.

As the force F applied against the door increases, the base of the door incrementally advances further up sloped surface 24 of the wedge element 1, therefore providing more resistance with every additional push. Sloped surfaces 24 covered in frictional materials 11, as shown in FIGS. 5 and 22, provide even greater resistance against the door. When the door can travel no further up the wedge element 1, device 10 may rock backwardly from the strong forces. Heel 4 of wedge element 1 is adapted to rock or tilt backwardly and thus prevent device 10 from slipping or sliding out from the door.

When heel 4 rocks backwardly, the anchoring elements that protrude from heel 4 and bottom 12 such as anchoring cleats 35 and grasping teeth 33 dig into the ground for added resistance. The close-up bubble in FIG. 22 illustrates the anchoring cleats 35 digging into the ground as heel 4 tilts backwardly. Anchoring cleats 35, grasping teeth 33, and other protrusions extending from heel 4 and bottom 12 dig in further as force F increases.

Figure 23:
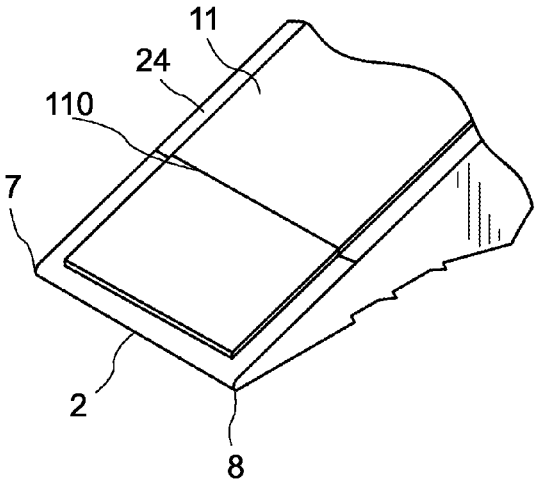
FIGS. 23-24 are partial front left isometric views of the wedge element of the present invention including a guide means.
Figure 24:
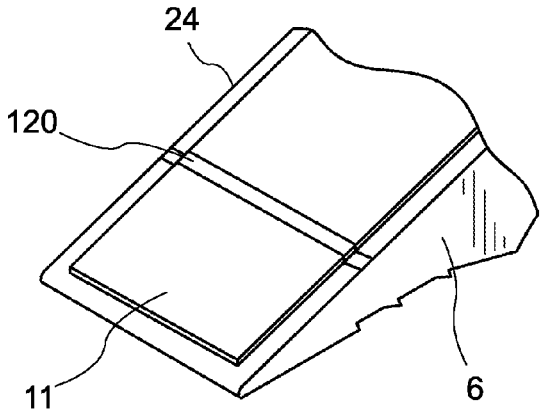

As shown in FIGS. 23 and 24, some embodiments may include a guide means, such as a brightly colored sticker 120 or a line 110 drawn across the sloped surface to indicate to the user how far to insert wedge element 1 for optimal effectiveness. Typically, the guide means traverse the entire sloped surface 24 and are substantially parallel to toe 2. Lines 110 may be drawn on or etched or carved through the frictional material 11. Similarly, sticker 120 can adhere over the frictional material 11 for greater visibility.

It should be understood, of course, that the foregoing relates to exemplary embodiments of the invention and that modifications may be made without departing from the spirit and scope of the invention as set forth in the following claims.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

The invention claimed is:

1. A portable access prevention device comprising:

a wedge element having a top, a bottom including a heel, a toe, a right side and a left side, wherein said bottom and said right side meet at a right edge and said bottom and said left side meet at a left edge, said top further includes a flat section and a sloped section, and said wedge element is adapted at said toe for placement underneath a door;

a leverage shaft having a top end and a bottom end, wherein said bottom end of said leverage shaft is non-rotationally fixed to said wedge element;

a leverage arm having a first end and a second end, said first end adapted to engage the door and receive a force applied against the door, said second end pivotally attached to said top end of said leverage shaft; and wherein said first end engages said door when rotated in a first direction, and disengages from said door when rotated in a second direction;

wherein the wedge element and the leverage shaft form a lever, and wherein the bottom includes a fulcrum of the lever.

2. The device of claim 1 further comprising:

wherein the first end of the leverage arm includes a faceplate having a front side and a back side; and a support brace having a first end and a second end, wherein said first end of said support brace is fixed to said back side of said faceplate and said second end is fixed to said leverage arm.

3. The device of claim 1 comprising:

wherein the first end of the leverage arm includes a faceplate having a front side and a back side; and wherein said faceplate includes a plate; and wherein the front side of the faceplate includes a convex surface.

4. The device of claim 1 comprising:

wherein the first end of the leverage arm includes a faceplate having a front side and a back side; and wherein said faceplate includes a plate having a substantially planar surface.

5. The device of claim 1 wherein said wedge element further comprises an anchoring element, wherein said anchoring element is adapted to dig into the ground; and said anchoring element is positioned between the fulcrum and the leverage shaft and is adapted to dig deeper into said ground when an increase in the force applied against the door is transferred through the leverage shaft to said wedge element.

6. The device of claim 1 wherein said heel of said wedge element is rounded.

7. The device of claim 1 wherein said heel of said wedge element is angled.

8. The device of claim 1 further comprising a strike plate adapted to receive a striking force, wherein said striking force positions said wedge element under said door.

9. The device of claim 8 wherein said strike plate is in communication with said heel of said wedge element.

10. The device of claim 1 wherein said leverage shaft further comprises a strike plate adapted to receive a striking force, wherein said striking force positions said wedge element under said door.

11. The device of claim 8 wherein said strike plate is a substantially planar surface adapted to be kicked.

12. The device of claim 10 wherein said strike plate is a substantially planar surface adapted to be kicked.

13. The device of claim 5 wherein said anchoring element further comprises at least one bottom protrusion projecting from said bottom of said wedge element.

14. The device of claim 5 wherein said anchoring element further comprises at least one heel protrusion projecting from said heel of said wedge element.

15. The device of claim 14 further comprising a plurality of protrusions longitudinally disposed along said bottom of said wedge element.

16. The device of claim 15 wherein said plurality of protrusions are positioned along said right edge and said left edge of said bottom of said wedge element.

17. The device of claim 13 wherein said at least one bottom protrusion is a grasping tooth.

18. The device of claim 14 wherein said at least one heel protrusion is an anchor cleat.

19. The device of claim 1 wherein said wedge element is made of rubber.

20. The device of claim 1 wherein said wedge element further comprises a guide line for ensuring proper placement of said wedge element under said door.

21. The device of claim 20 wherein said guide line includes a visible line traversing said wedge element and wherein the guide line is substantially parallel to said toe.

22. The device of claim 20 wherein said guide line includes a sticker placed on said sloped section of said wedge element.

23. A method of using a portable access prevention device, the device comprising:

a wedge element having a top, a bottom including a heel, a toe, a right side and a left side, wherein said bottom and said right side meet at a right edge and said bottom and said left side meet at a left edge, said top further includes a flat section and a sloped section, and said wedge element is adapted at said toe for placement underneath a door;

a leverage shaft having a top end and a bottom end, wherein said bottom end of said leverage shaft is non-rotationally fixed to said wedge element;

a leverage arm having a first end and a second end, said first end adapted to engage the door, said second end pivotally attached to said top end of said leverage shaft; and wherein said first end engages said door when rotated in a first direction, and disengages from said door when rotated in a second direction;

wherein the wedge element and the leverage shaft form a lever, and wherein the bottom includes a fulcrum of the lever;

wherein the method comprises:

placing, by a user said wedge element under an inwardly swinging door, swinging said leverage arm in said first direction such that said first end engages said door, said first end receives a force applied against the door and transfers said force to said leverage arm, which transfers said force to said leverage shaft, which transfers said force to said wedge element, which drives said wedge element further into the ground and under said door as said force increases.

24. The method of claim 23, wherein the portable access prevention device further comprises a strike plate adapted to receive a striking force, wherein said striking force positions said wedge element under said door; the method further comprising: wherein a user places said wedge element under the inwardly swinging door, applies the striking force to said strike plate, swings said leverage arm in said first direction such that first end engages said door, said first end receives the force applied against the door and transfers said force to said leverage arm, which transfers said force to said leverage shaft, which transfers said force to said wedge element, which drives said wedge element further into the ground and under said door as said force increases.

25. A portable access prevention device according to claim 1 further comprising:

wherein the first end of the leverage arm includes a faceplate having a front side and a back side.

26. The device of claim 25 wherein said wedge element further comprises an anchoring element, wherein said anchoring element is adapted to dig into the ground; and said anchoring element is positioned between the fulcrum and the leverage shaft and is adapted to dig deeper into said ground when an increase in the force applied against the door is transferred through the leverage shaft to said wedge element.

27. The device of claim 25 wherein said heel of said wedge element is rounded.

28. The device of claim 25 wherein said heel of said wedge element is angled.

29. The device of claim 25 further comprising a strike plate adapted to receive a striking force, wherein said striking force positions said wedge element under said door.

30. The device of claim 29 wherein said strike plate is in communication with said heel of said wedge element.

31. The device of claim 25 wherein said leverage shaft further comprises a strike plate adapted to receive a striking force, wherein said striking force positions said wedge element under said door.

32. The device of claim 29 wherein said strike plate is a substantially planar surface adapted to be kicked.

33. The device of claim 31 wherein said strike plate is a substantially planar surface adapted to be kicked.

34. The device of claim 26 wherein said anchoring element further comprises at least one bottom protrusion projecting from said bottom of said wedge element.

35. The device of claim 26 wherein said anchoring element further comprises at least one heel protrusion projecting from said heel of said wedge element.

36. The device of claim 35 further comprising a plurality of protrusions longitudinally disposed along said bottom of said wedge element.

37. The device of claim 36 wherein said plurality of protrusions are positioned along said right edge and said left edge of said bottom of said wedge element.

38. The device of claim 34 wherein said at least one bottom protrusion is a grasping tooth.

39. The device of claim 35 wherein said at least one heel protrusion is an anchor cleat.

40. The device of claim 25 wherein said wedge element is made of rubber.

41. The device of claim 25 wherein said wedge element further comprises a guide line for ensuring proper placement of said wedge element under said door.

42. The device of claim 41 wherein said guide line includes a visible line traversing said wedge element and wherein the guide line is substantially parallel to said toe.

43. The device of claim 41 wherein said guide line includes a sticker placed on said sloped section of said wedge element.

44. The method of claim 23 the device further comprising:

wherein the first end of the leverage arm includes a faceplate having a front side and a back side; wherein the method further comprises: the faceplate receiving the force applied against the door and transferring the force to the leverage arm.

45. The method of claim 44 the portable access prevention device further comprising a strike plate adapted to receive a striking force, wherein said striking force positions said wedge element under said door;

wherein the method further comprises applying the striking force to said strike plate.

* * * * *